United States Patent [19]

Iacovangelo et al.

[11] Patent Number: 4,863,766

[45] Date of Patent: Sep. 5, 1989

[54] ELECTROLESS GOLD PLATING COMPOSITION AND METHOD FOR PLATING

[75] Inventors: Charles D. Iacovangelo, Schenectady; Kenneth P. Zarnoch, Scotia, both of N.Y.

[73] Assignee: General Electric Company, Schenectady, N.Y.

[21] Appl. No.: 64,435

[22] Filed: Jun. 22, 1987

Related U.S. Application Data

[63] Continuation-in-part of Ser. No. 902,543, Sep. 2, 1986, abandoned, and a continuation-in-part of Ser. No. 751,717, Jul. 5, 1985, abandoned.

[51] Int. Cl.[4] ..... B05D 1/18

[52] U.S. Cl. ..... 427/443.1; 427/437; 427/304

[58] Field of Search ..... 427/443.1, 304, 437; 428/936

[56] References Cited

U.S. PATENT DOCUMENTS

| | | | |
|---|---|---|---|
| 3,032,436 | 5/1962 | Gostin | 106/1.26 |
| 3,396,042 | 8/1968 | Duva | 427/304 |
| 3,476,594 | 11/1969 | Soderberg | 427/161 |
| 3,515,571 | 6/1970 | Levy | 427/162 |
| 3,589,916 | 6/1971 | McCormack . | |
| 3,700,469 | 10/1972 | Okinaka | 427/443.1 |
| 3,917,885 | 11/1975 | Baker . | |
| 4,005,229 | 1/1977 | Miller | 427/304 |
| 4,091,128 | 5/1978 | Franz | 427/443.1 |
| 4,092,154 | 5/1978 | Dietz Jr. et al. . | |
| 4,307,136 | 12/1981 | Prost-Tournier | 427/443.1 |
| 4,337,091 | 6/1982 | El-Shazly | 427/443.1 |
| 4,374,876 | 2/1983 | El-Shazly | 427/443.1 |
| 4,474,838 | 10/1984 | Halecky | 427/443.1 |

FOREIGN PATENT DOCUMENTS

| | | | |
|---|---|---|---|
| 0229478 | 12/1984 | Japan | 427/443.1 |
| 2121444 | 6/1983 | United Kingdom . | |

OTHER PUBLICATIONS

Douglas K. Simpson, "Hydrazine: A Powerful Metal Reductant" Metal Finishing, Apr. 1985, pp. 57–60.

J. Electrochem. soc., vol. 121, No. 1, Jan. 1974, Okinaka et al., "some Practical Aspects of electroless Gold Plating", pp. 56–62.

Plating and surface Finishing, May 1988, Matsuoka et al., "Heavy Deposition of Electroless Gold", pp. 102–106.

Ali & Christie, *Gold Bull.*, 1984, 17, (4), "a Review of Electroless Gold Deposition Processes", pp. 118–127 and p. 144.

ASM 88-02 58 0116, *J. Met. Finish. soc. Jpn.*, vol. & Issue 38, (2), (1987), Imanishi et al., pp. 55–60.

*Primary Examiner*—Shrive Beck

*Assistant Examiner*—Vi Duong Dang

*Attorney, Agent, or Firm*—Mary A. Montebello; James C. Davis Jr.; William H. Pittman

[57] ABSTRACT

An aqueous electroless gold plating composition is disclosed comprising a water-soluble alkali metal monovalent gold cyanide complex, a water-soluble alkali metal complexing agent and hydrazine or its derivatives. A method for electrolessly plating gold onto a nickel substrate is also disclosed.

1 Claim, 2 Drawing Sheets

ELECTROLESS GOLD PLATING COMPOSITION AND METHOD FOR PLATING

This application is a continuation-in-part of the Ser. No. 902,543 filed on Sept. 2, 1986 now abandoned which is a continuation-in-part of Ser. No. 751,717 filed on July 5, 1985 now abandoned.

BACKGROUND OF THE INVENTION

This invention relates to the coating of nickel with gold as, for example, is required in the preparation of ceramic carriers employed in the packaging of semiconductor chips.

The increased performance and circuit/bit densities of today's semiconductor chips require corresponding technological advancements in chip packaging. Since the introduction of the leadless ceramic chip carrier, the chip carrier packaging concept has seen increasing use. Ceramic chip carriers typically make use of alumina-based substrates and have discrete areas of multi-layer metallization bonded to the ceramic substrate. These areas of metallization comprise in sequence (a) a base metallization layer bonded to the ceramic substrate, (b) a layer of nickel bonded to the initial, or base, layer and (c) a layer of gold bonded to the nickel layer.

In the typical fabrication of multi-layer ceramic substrates alumina powder is mixed with glass frit and organic chemicals to form a slurry. This slurry is cast into sheets having a controlled thickness, which sheets are then blanked into various sizes and shapes, and via holes are punched. These green sheets are then screen printed with tungsten (or molybdenum) to form the base metallization. These metallized green sheets are stacked, and laminated together, followed by cofiring (i.e., sintering) in hydrogen or a hydrogen-nitrogen mixture with the heating schedule usually peaking at 1550° C. -1650° C. Thereafter, these sintered substrates are processed to apply nickel metallization over the exposed discrete areas of sintered tungsten. This is followed in turn by gold metallization of the nickel surfaces. Actual compositions of the slurry and specifics of the processing can be expected to vary from manufacturer to manufacturer.

The tungsten metallization is about 10 micrometers thick and is very porous. The nickel layer applied thereto is typically 2-5 micrometers thick and applied by either electrolytic or electroless nickel plating. The nickel functions both to aid in wire bonding and to provide a better thermal expansion match between the tungsten and gold layers on opposite sides thereof. The thin layer of gold, typically 1-2 micrometers thick, is applied to accommodate die attachment, wire bonding and sealing. For good hermeticity (and for other reasons) it is important that the nickel and the gold metallizations contain as few pores as possible.

In U.S. patent application Ser. No. 740,377—Park, "Nickel Coating Diffusion Bonded To Metallized Ceramic Body And Coating Method", filed June 3, 1985, now U.S. Pat. No. 4,590,095 pack cementation is used to diffusion bond substantially pore-free nickel to discrete exposed areas of tungsten or molybdenum that are in turn bonded to the surface of a ceramic body. The preferred method for using the gold plating formulation of this invention is described in U.S. patent application Ser. No. 753,094—Zarnoch and Iacovangelo, "Control of Cyanide Activity In Electroless Plating Compositions", filed July 9, 1985. Both the aforementioned applications are assigned to the assignee of the invention described and claimed herein and are incorporated by reference.

The sintered multi-layer ceramic bodies provided with the discrete areas of multi-layer metallization are subsequently subjected to brazing, chip joining and capping operations.

High purity nickel and gold deposits generally can be obtained by electrolytic plating. It is well known, however, that this process has several major drawbacks including the following: (a) because of the need for an externally applied electrical current, it is often difficult to plate articles with complex shapes and circuitry; (b) for the same reason, the resulting nickel or gold coating is generally very nonuniform being thicker in well-exposed areas and substantially thinner at corners, and (c) such coatings tend to be porous.

Because of these and other disadvantages of the electrolytic mode of plating, nickel and gold metallizations of ceramic chip carriers increasingly are carried out by electroless plating. This latter method can plate articles regardless of complexity of shape or circuitry with a relatively uniform coating thickness. This result is due to the fact that the surface to be plated is subjected to pretreatment rendering the surface catalytic to the metal deposition and each unit area should be equally catalytic. Additionally, metals deposited electrolessly plate well into holes and around corners.

U.S. Pat. No. 3,700,469—Okinaka discloses an autocatalytic (i.e., electroless) gold bath formulation employing a gold cyanide complex, excess free cyanide, a pH adjusting agent and a borohydride or amine borane as the reducing agent. Such a bath exhibits advantages over displacement electroless baths, since the latter dissolve the substrate material and are also incapable of allowing higher plating thicknesses. However, the composition described in Okinaka has its own limitations: inadequate stability, low gold plating rate, difficulty in replenishing the bath, and sensitivity to the presence of nickel ions.

The electroless gold bath composition disclosed in U.S. Pat. No. 3,917,885—Baker employing an aqueous solution of an alkali metal imide complex of the metal to be plated purportedly exhibits improved stability, but is found to suffer from the same problems as Okinaka, especially sensitivity to nickel contamination.

U.S. Pat. No. 4,337,091—El-Shazly et al. proposes the use of trivalent gold metal complexes as the source of gold in an electroless gold plating bath, the reducing agent being any of the borohydrides, cyanoborohydrides or amine boranes that are soluble and stable in aqueous solution. A later version of the El-Shazly et al. electroless gold plating bath using a mixture of trivalent and monovalent water-soluble gold components is described in U.K. Patent Application G.B. No. 2121444A. This latter item of prior art suggests the use of hydrazine as a reducing agent and speaks of plating rates of up to 8 microns per hour. As with the other prior art electroless gold plating formulations the El-Shazly baths are easily contaminated by nickel.

DESCRIPTION OF THE INVENTION

The invention consists of the composition of aqueous electroless gold plating baths, the lives of which are stable and which yield, under appropriate conditions, gold plating deposition at the rate of from about 5 micrometers per hour to at least 20 micrometers per hour. Gold electrolessly deposited by the formulation of this invention is of high purity, bright lemon-yellow in color and of low porosity. Adhesion of the gold deposit to the areas of nickel metallization on a chip carrier substrate is acceptable.

In contrast to prior art formulations, the electroless gold plating baths of this invention are extremely stable in operation, provide a high gold plating rate using monovalent gold complexes and contain very low concentrations of free cyanide expressed as $CN^-$. These baths have been found to be extremely stable to contamination by nickel.

This electroless gold plating composition comprises a water-soluble alkali metal monovalent gold cyanide complex, a water-soluble alkali metal cyanide as a complexing agent, hydrazine as the reducing agent and a water-soluble alkali metal alkaline agent for adjusting the pH of the bath. It is the unique combination of the hydrazine and the cyanide complexing agent that is responsible for the unexpectedly improved properties of this electroless gold plating composition when plating onto nickel. For example, in using hydrazine, the displacement of nickel from the substrate is prevented. According to the plating method described herein, gold plates onto a gold surface only when the gold surface is in contact with an underlying nickel layer. This plating composition may thus be characterized as being "substrate-catalyzed". Plating continues as long as the nickel substrate itself remains in contact with the plating composition. A key feature of the bath is that any gold seeds which might form therein do not act as deposition sites for more gold, but instead redissolve in the bath. Thus, during plating, the bath composition remains extremely stable.

BRIEF DESCRIPTION OF THE DRAWING

The features of this invention believed to be novel and unobvious over the prior art are set forth with particularity in the appended claims. The invention itself, however, as to the organization, method of operation and objects and advantages thereof, may best be understood by reference to the preceding and to the following description taken in conjunction with the accompanying drawings wherein:

MANNER AND PROCESS FOR MAKING AND USING THE INVENTION

Figure 1:
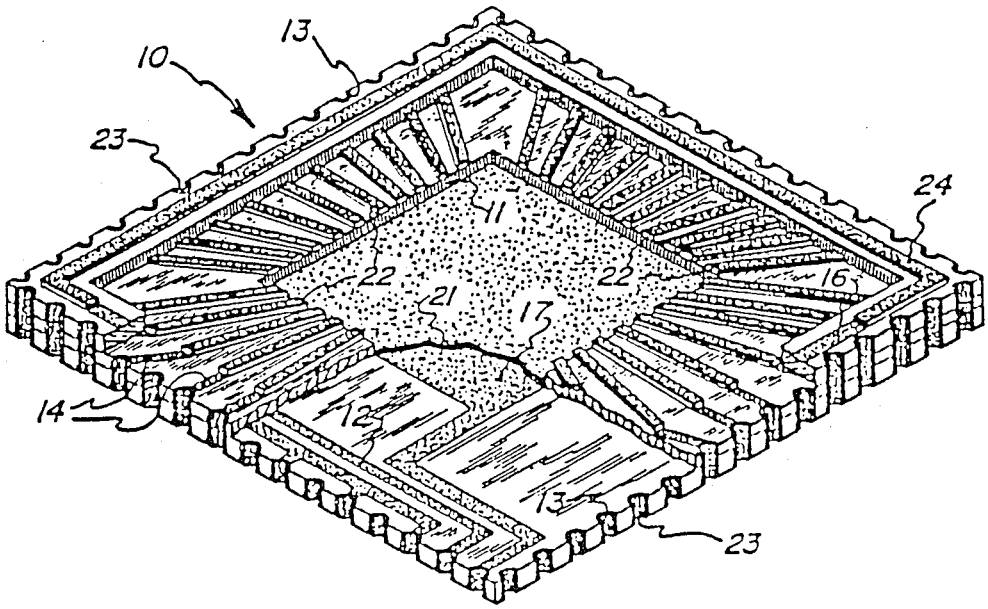
FIG. 1 is a schematic three-dimensional view of a simple multi-layer ceramic chip carrier partly cut away to show the initially applied (i.e., base) discrete areas of metallization, the exposed portions of which (after assembly and sintering of the green sheets) have each received a nickel overlay ready for the application of the subsequent layer of gold using the electroless gold plating formulation of this invention.

Referring now to the drawing, the stacked, laminated and partially metallized ceramic body 10 is an incomplete chip carrier in that the final metallization layer (i.e., the gold) has not yet been deposited. The semiconductor chip (not shown) to be housed in chip carrier 10 would be mounted and soldered in place in recess 11. The ceramic material typically used is alumina containing 5–10% glass. The discrete areas of tungsten metallization shown in various configurations are applied by screen printing to the green sheets prior to stacking and laminating. Portions of the tungsten metallization remain exposed after the lamination and these are the portions which receive the nickel overlays and, subsequently, the gold deposits of this invention. The tungsten metallization layers, such as are represented by numerals 12, 13, 14, 16 and 17 are interconnected as required for the particular circuitry. The tungsten metallization resulting from the sintering step is bonded to the ceramic, is about 10 micrometers thick and is very porous.

The nickel metallization may be accomplished, for example, by electroless deposition or by the practice of the invention in the Park application described above, Ser. No. 740,377 now U.S. Pat. No. 4,590,095.

The ceramic body upon completion of the electroless nickel deposition is that represented in the drawing. The nickel metallization layers 21, 22, 23 and 24 have been deposited on the underlying areas of tungsten metallization.

When the nickel metallization has been completed, cleaning of these areas of nickel on the substrate with distilled water rinses usually is the only treatment required in preparation for the gold plating. Thus, in the case of electroless nickel plating the number of distilled water rinses should be sufficient to render the nickel surfaces chemical-free.

The gold plating is conducted in a vessel made of material (e.g., a plastic such as polypropylene) inert to the plating chemicals. Relative movement between the substrate(s) and the plating bath is accomplished by stirring the bath and, preferably, also agitating the substrate(s). The plating solution is heated either internally or externally. Stirring of the bath provides both chemical homogeneity and uniform plating solution temperature while substrate agitation dislodges gas bubbles, which may form thereon during plating and adhere thereto. Gas bubbles adhering to the nickel surfaces can block fresh plating solution from reaching all of the nickel surface. If this occurs, plating efficiency is reduced.

To carry out the electroless gold plating on a given substrate, it is simply immersed in the stirred plating solution for an exposure time providing the requisite gold deposit thickness. Thereafter it is simply removed from the bath and immediately rinsed with distilled water to remove any residual plating chemicals from the plated gold metal surfaces. Generally the rinse water is quickly removed by blotting the substrate dry or by immersion of the substrate in sequence in a series of solvents.

As briefly mentioned above, a key feature of the method of the present invention is the extreme stability of the bath, even at very high plating rates. This phenomenon is due in part to the preferential poisoning of hydrazine oxidation on a discrete gold surface (e.g., a gold seed) while hydrazine oxidation and gold reduction continue to occur on the substrate of interest (e.g., nickel). Furthermore, the substrate is not consumed while the gold layer is applied: thus, the displacement of substrate metal is prevented.

The following table describes a preferred gold plating bath composition (1 liter) with optimal concentrations given providing the greatest stability (i.e., with respect to bath life and operating conditions).

TABLE I

| | | |
|---|---|---|
| about 975 ml | Distilled $H_2O$ | |
| 5 g | $KAu(CN)_2$ | Potassium Gold Cyanide |
| 50 g | KOH | Potassium Hydroxide |
| 0.45 g | KCN | Potassium Cyanide |
| 25 ml | $NH_2NH_2.H_2O$ | Hydrazine Hydrate |

Hydrazine can be replaced by a derivative thereof, such as hydroxyethylhydrazine, hydrazine sulfate or hydrazine dihydrochloride.

The electroless plating baths of this invention will be maintained at a pH in the range of about 10 to about 14, and more preferably, at a pH of about 12–14. Furthermore, the bath may contain a buffering agent, such as an alkali metal citrate. The alkaline plating formulation set forth hereinabove will have a pH of about 14 and is normally used at a temperature between about 70° C. and 100° C. Optimal operation will be at 80° C., at which temperature the rate of gold deposition is greater than 20 micrometers per hour to a thickness of at least 6 micrometers.

In carrying out the gold plating of substrates on a continuing basis (until the cyanide activity reaches an undesirable lever) all components of the formulation selected, except the alkali cyanide complexing agent, should be added to the plating bath at regular intervals to replenish the bath. Preferably the components being added are introduced in aqueous form such that they replenish the bath to within 20% or less of its original concentration. The plating solution volume is maintained by introducing distilled water to offset water lost by evaporation.

When the gold plating is carried out employing the invention of Ser. No. 753,094, i.e., controlling cyanide activity, a dilute aqueous solution of metal ions which are able to complex with cyanide ions is also added to the bath. This technique accompanies the replenishing activities referred to above. An exemplary metal ion is $Ni^{++}$, and in that instance, the nickel cyanide complex is $Ni(CN)^{=}_4$. The amount of $Ni^{++}$ added (e.g., as nickel acetate) should be such that the cyanide activity is not reduced below about 0.25 g KCN/liter of solution. For example, the nominal minimal activity of $CN^-$ should be about 4 millimolar. The frequency of $Ni^{++}$ addition should be such that the cyanide activity does not vary more than ±1 millimolar.

EXAMPLE 1

Several ceramic chip carrier substrates similar in design to the chip carrier 10 in FIG. 1, which had been electrolessly plated with a nickel-boron alloy, subsequently heat treated in cracked ammonia at 750° C. for 15 minutes and then heat treated in 10% $H_2$90% Ar at 750° C. for 30 minutes were gold plated using the electroless plating composition described hereinabove (TABLE I).

A quantity of gold plating composition (20 ml) was placed in a 50 ml polypropylene beaker and the beaker was partially immersed in a heated oil bath to maintain the gold plating solution at a temperature of 80° C. (±1° C.). Each chip carrier substrate had a nominal value for the nickel metallization surface area of 1.8 $cm^2$. This value together with weight gain was used to calculate equivalent gold thickness (assuming the deposit to be 100% dense). One of the chip carrier substrates was immersed in the heated plating solution so that all exposed surfaces thereof were exposed to the solution. The substrate remained stationary and the solution was stirred using a magnetic stirbar, the period of immersion being 10 minutes. It was then removed from the plating bath, rinsed several times with distilled water and blotted dry. The equivalent gold thickness obtained was 1.3 μm, the gold deposit being bright lemon-yellow in appearance. Scanning electron microscopy (SEM) observation at 3000× showed the deposit of gold to be smooth and relatively pore-free.

Figure 2:
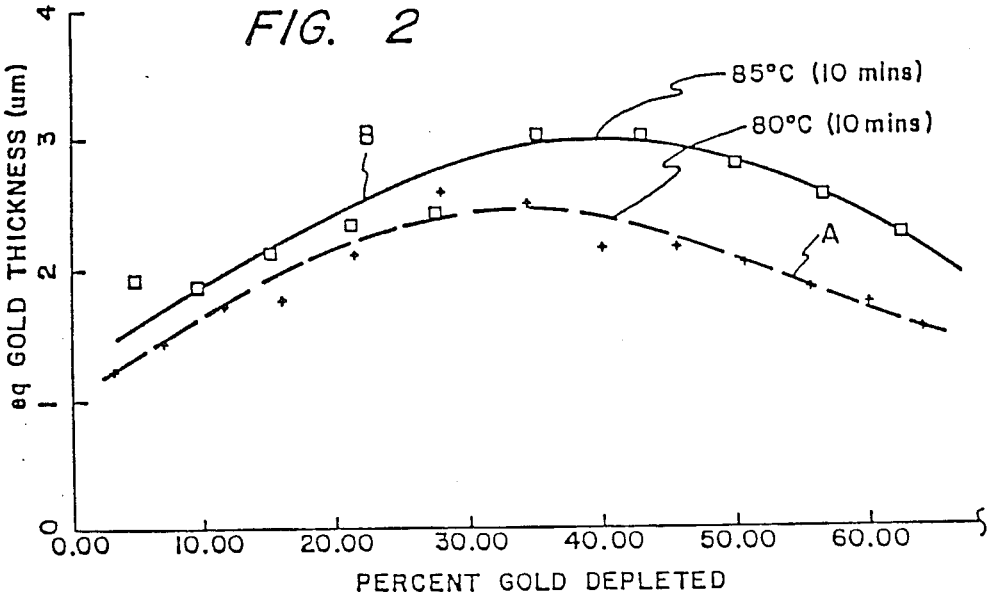
FIG. 2 is a graph in which equivalent gold thickness is plotted as a function of the percent gold depleted for a series of chip carrier substrates and FIG. 3 is a graph in which equivalent gold thickness is plotted as a function of exposure time in the plating bath at 90° C.

The curves of FIG. 2 were obtained using the plating formulation set forth in TABLE I to gold plate a series of chip carrier substrates identical to the one the gold plating of which is described above. The series of substrates was plated in sequence in the same plating bath (without being replenished) each being plated for 10 minutes. For each point plotted the gold deposit thickness is calculated from the substrate weight gain. Curve A is the plot of data from Example 1 while Curve B is the plot of data from Example 2.

EXAMPLE 2

Chip carrier substrates identical to that for Example 1 were plated with gold in a volume of 20 ml of a freshly prepared gold bath of the given composition. All experimental conditions were identical to Example 1 except that the temperature of the solution was maintained at 85° C. (±1° C.). The first sample plated built to a thickness of 1.9 μm Au and was of a bright lemon yellow appearance.

EXAMPLE 3

Figure 3:
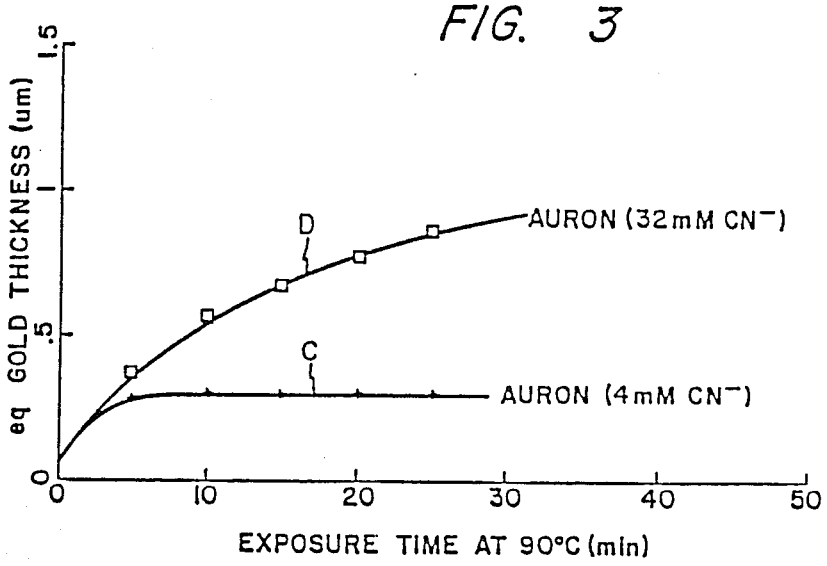

A metal foil substrate of 99.9% Ni was treated and gold plated as follows. The nickel foil sample was 0.013 cm thick and nominally 4.4 $cm^2$ in surface area. To allow subsequent uniform gold deposition the nickel foil was pretreated prior to gold plating by (a) immersing in trichloroethylene for 2 minutes at room temperature and air dried, (b) exposing to a 50% aqueous solution of HCl at room temperature for 2 minutes with mild agitation of the substrate and (c) distilled water rinsing and then blotting the surface dry. Gold plating of this substrate was then done by immersing the substrate in a solution volume of 20 ml of the gold plating composition of TABLE I, except for $CN^-$ activity while the solution temperature was maintained at 90° C. All other experimental conditions are identical to Example 1. The substrate was exposed to the gold plating solution for a total of 25 minutes. After each 5 minute increment, the substrate was removed, rinsed with distilled $H_2O$ and blotted dry and then weighed to determine the weight of gold deposited. FIG. 3 (Curve C) shows a plot of the equivalent gold thickness (again calculated from the weight gain of Au) versus exposure time to this bath at 90° C. with a nominal $CN^-$ activity of 4 millimolar.

EXAMPLE 4

A nickel foil substrate of identical purity and of substantially the same size and shape as in Example 3 and pretreated as in Example 3 was plated with gold as follows. A solution volume of 20 ml of the gold bath composition of TABLE I was freshly prepared. To this composition was added additional KCN such that the $CN^-$ activity was raised from a nominal value of 4 millimolar up to 32 millimolar. Under identical experimental conditions as that of Example 3, the substrate was plated with gold for a total of 25 minutes at 90° C. As in Example 3 the substrate was removed after each of a series of 5 minute increments of exposure to the bath, rinsed, dried and weighed to determine (by calculation) the thickness of gold obtained. FIG. 3 (Curve D) shows the plot for the case of having nominally 32 millimolar $CN^-$ activity.

Thus, FIG. 3 demonstrates that thickness may be controlled according to the present invention by varying the cyanide activity. This is in contrast to the prior art processes wherein thickness can only be controlled by varying the plating time.

TABLE II displays a series of additional examples. In each example the substrate was a chip carrier as described and prepared in EXAMPLE 1.

TABLE II

| Composition (to make about 1 liter) | Example 5 | Example 6 | Example 7 | Example 8 | Example 9 |
|---|---|---|---|---|---|
| distilled $H_2O$ | 975 ml | 750 ml | 997.5 ml | 975 ml | 997.5 ml |
| $KAu(CN)_2$ | 0.10 g | 50 g | 7.9 g | 5 g | 7.9 g |
| KOH | 50 g | 50 g | 50 g | — — | |
| KCN | 0.035 g | 10 g | 0.25 g | 0.25 g | 0.25 g |
| $NH_2NH_2.H_2O$ | 25 ml | 250 ml | 2.5 ml | 25 ml | 2.5 ml |
| Volume of solution | 100 ml | 20 ml | 100 ml | 100 ml | 100 ml |
| pH (ambient temperature) | 14 | 14 | 14 | 11.0 | 10.6 |
| substrate | chip carrier | chip carrier | chip carrier | chip carrier | chip carrier |
| Exposure Time @ 90° C. | 10 min. | 10 min. | 10 min. | 10 min. | 10 min. |
| Au thickness | 0.11 μm | 2.24 μm | 0.38 μm | 0.20 μm | 0.29 μm |

These examples illustrate the variations in composition that can be employed in the practice of this invention.

Equation (1) and the formula for the equilibrium constant of Equation (1) are used as guidelines for making selections of useful variants of the composition of TABLE I.

$$4[KAu(CN)_2] + 4KOH + NH_2NH_2 \xrightarrow{K} 4Au^\circ + 8KCN + N_2 + 4H_2O \quad (1)$$

-continued $$K = \frac{[Au^\circ]^4[KCN]^8[N_2][H_2O]^4}{[KAu(CN)_2]^4[KOH]^4[NH_2NH_2]}$$

The criterion applied is that a change selected to be made in the concentration of one species must be compensated for in the other species such as to keep the value of K constant.

Any electrochemical material active toward hydrazine oxidation, such as, but not limited to, Cu, Ag, Pd, Si, Pt, Co, W, Mo and Ni are suitable as substrates to effect gold deposition.

Experiments using alkali metal trivalent gold cyanides have established the very significant superiority of monovalent gold cyanides in the practice of this invention in contrast to the teachings in prior art referred to hereinabove.

What is claimed is:

1. A process for applying a layer of gold from an electroless plating bath to a nickel substrate in which the nickel substrate and the electroless plating bath are protected against both contamination by nickel ions from the substrate and autocatalytic deposition of gold on gold which comprises immersing the substrate to be plated into a plating bath comprising potassium gold cyanide, a water soluble alkali metal cyanide complexing agent, and a hydrazine reducing agent, said bath having a free cyanide activity of between 4 and 32 millimolar and a pH between 12 and 14.

* * * * *